US005943939A

United States Patent [19]

Orihara

[11] Patent Number: 5,943,939

[45] Date of Patent: Aug. 31, 1999

[54] FLUID PRESSURE CYLINDER

[75] Inventor: Shun Orihara, Yawara-mura, Japan

[73] Assignee: SMC Corporation, Japan

[21] Appl. No.: 08/978,365

[22] Filed: Nov. 25, 1997

[30] Foreign Application Priority Data

Dec. 6, 1996 [JP] Japan ..... 8-340378

[51] Int. Cl.[6] ..... F15B 15/22

[52] U.S. Cl. ..... 91/407; 92/85 B

[58] Field of Search ..... 91/407, 404, 405, 91/406; 92/85 R, 85 B

[56] References Cited

U.S. PATENT DOCUMENTS

| | | | |
|---|---|---|---|
| 2,870,744 | 1/1959 | Hallerstrom | 91/407 X |
| 3,162,092 | 12/1964 | Corwin | 91/407 X |
| 5,517,898 | 5/1996 | Kim et al. | 91/407 X |
| 5,692,429 | 12/1997 | Sonntag | 91/407 X |

FOREIGN PATENT DOCUMENTS 6213214 2/1994 Japan .

*Primary Examiner*—Hoang Nguyen
*Attorney, Agent, or Firm*—Baker & Botts, L.L.P.

[57] ABSTRACT

A fluid pressure cylinder wherein the configuration of a gasket groove for dividing a flow path is changed such that a first communicating passage (and a piping port), a cushion valve inserting hole (and a cushion valve control hole), etc. can be disposed to be close to or coincident with each other in the axial direction. The first communicating passage and the cushion valve inserting hole for a cushion valve are disposed to be close to or coincident with each other in the axial direction and displaced relative to each other at a predetermined angle with respect to the center line of the cylinder. The outer peripheral surface of an end cover is provided with a gasket groove having a predetermined width in the axial direction to divide the first communicating passage and the cushion valve inserting hole from each other. The gasket groove is fitted with a gasket.

7 Claims, 3 Drawing Sheets

FLUID PRESSURE CYLINDER

BACKGROUND OF THE INVENTION

The present invention relates to fluid pressure cylinders used to move objects in various production or processing facilities.

In a typical fluid pressure cylinder, a cushioning structure is used to decelerate the associated piston at an end of its stroke. In many of the conventional fluid pressure cylinders, the outer diameter of an end cover is larger than the outer diameter of a cylinder tube. A cushion valve extends to the upper side of the end cover, for example, and a piping port opens on a side of the end cover. To meet a demand for a reduction in the size of a fluid pressure cylinder and for savings in constituent materials, it was conceived to arrange a fluid pressure cylinder as shown in FIG. 3. That is, the diameter of an end cover 12 is set equal to the inner diameter of a cylinder tube 11, and the end cover 12 is fitted to the inner surface of the cylinder tube 11.

In the prior art shown in FIG. 3, the cylinder tube 11 has a large-diameter portion 11*a* defined with a step portion formed on the inner surface of an end portion thereof. The end cover 12 has a large-diameter portion 12*a* defined with a step portion formed on the outer surface of an end portion thereof. The end cover 12 is inserted into the end portion of the cylinder tube 11, and the large-diameter portion 12*a* of the end cover 12 is fitted to the large-diameter portion 11*a* of the cylinder tube 11. The position in the axial direction of the end cover 12 is determined by engagement between the step portions of the end cover 12 and the cylinder tube 11. The large-diameter portion 11*a* of the cylinder tube 11 is provided with an annular groove, and a retaining ring 13 is fitted in the annular groove to prevent the end cover 12 from falling out of the cylinder tube 11. A piston 15 is slidably fitted to the inner surface of the cylinder tube 11. A piston rod 16 is connected to the piston 15. A cushion ring 18 is formed on a side of the piston 15 closer to the piston rod 16, and a cushion plunger 17 is formed on the other side of the piston 15. The end cover 12 has a center bore 21. The center bore 21 has a small-diameter portion 21*a*, an intermediate-diameter portion 21*b*, and a large-diameter portion 21*c* in order from the outside in the axial direction (i.e. from the left side in FIG. 3). The small-diameter portion 21*a* is pierced by the piston rod 16 with a seal 22 provided therebetween. The large-diameter portion 21*c* is fitted with a cushion packing 37. The piston 15 has a packing 19 fitted in an annular groove on the outer periphery thereof. The packing 19 hermetically seals the area of sliding contact between the piston 15 and the cylinder tube 11.

A piping port 23 is formed in the cylinder tube 11 at a position near the end thereof. The piping port 23 is communicated with the intermediate-diameter portion 21*b* of the center bore 21 in the end cover 12 through a first communicating passage 24. The cylinder tube 11 is provided with a cushion valve control hole 25 axially adjacent to the piping port 23. The end cover 12 is provided with a cushion valve inserting hole 26 in a coaxial relationship to the cushion valve control hole 25. The cushion valve inserting hole 26 has a large-diameter portion, a threaded-bore portion, a valve chamber 28, and a valve seat portion in order from the outside in the radial direction of the end cover 12. A cushion valve (needle valve) 27 is inserted into the cushion valve inserting hole 26. The valve chamber 28 is communicated with a rod-side chamber 30 in the cylinder tube 11 through a second communicating passage 29. The valve chamber 28 is also communicated with the intermediate-diameter portion 21*b* of the center bore 21 in the end cover 12 through a valve seat. The cushion valve 27 has a large-diameter portion, an external thread portion, and a needle portion in order from the outside in the radial direction of the end cover 12. The external thread portion is engaged with the threaded-bore portion of the cushion valve inserting hole 26. The space between the cushion valve 27 and the cushion valve inserting hole 26 is hermetically sealed with an O-ring fitted in an annular groove on the large-diameter portion. By rotating the cushion valve 27, the gap between the needle portion and the valve seat is varied to control the flow rate of a fluid flowing through a bypass flow path (including the second communicating passage 29) that provides communication between the intermediate-diameter portion 21*b* of the center bore 21 and the rod-side chamber 30.

The outer peripheral surface of the end cover 12 is provided with a first annular gasket groove 33, a second annular gasket groove 34, and a third annular gasket groove 35 such that the three gasket grooves 33, 34 and 35 lie in three planes, respectively, which are perpendicular to the center line X—X of the cylinder tube 11. The first annular gasket groove 33 is located axially outward of the first communicating passage 24. The second annular gasket groove 34 is located between the first communicating passage 24 and the cushion valve inserting hole 26 with respect to the axial direction. The third annular gasket groove 35 is located axially inward of the cushion valve inserting hole 26. The first, second and third annular gasket grooves 33, 34 and 35 are fitted with a first annular gasket 33*a*, a second annular gasket 34*a* and a third annular gasket 35*a*,respectively. It should be noted that illustration of the reference characters of the three gaskets is omitted in FIG. 3. The first annular gasket 33*a* hermetically seals the joint between the cylinder tube 11 and the end cover 12 to prevent communication between the atmosphere on the one hand and the piping port 23 and the first communicating passage 24 on the other. The second annular gasket 34*a* hermetically seals the joint between the cylinder tube 11 and the end cover 12 to prevent communication between the piping port 23 and the first communicating passage 24 on the one hand and the cushion valve control hole 25 and the cushion valve inserting hole 26 on the other. The third annular gasket 35*a* hermetically seals the joint between the cylinder tube 11 and the end cover 12 to prevent communication between the cushion valve control hole 25 and the cushion valve inserting hole 26 on the one hand and the rod-side chamber 30 on the other.

SUMMARY OF THE INVENTION

In the fluid pressure cylinder shown in FIG. 3, three annular gasket grooves 33 through 35 are axially spaced on the end cover 12 to lie in three planes, respectively, which are perpendicular to the center line X—X of the cylinder tube 11, and the first communicating passage 24 (and the piping port 23) and the cushion valve inserting hole 26 (and the cushion valve control hole 25) are disposed between the three axially spaced annular gasket grooves 33 through 35. Accordingly, there is a limit to the reduction of the axial length of the end cover 12. Therefore, it has heretofore been impossible to satisfactorily reduce the overall size of the fluid pressure cylinder and save constituent materials.

An object of the present invention is to provide a fluid pressure cylinder in which the configuration of a gasket groove for dividing a flow path is changed such that the first communicating passage (and the piping port), the cushion valve inserting hole (and the cushion valve control hole), etc. can be disposed to be close to or coincident with each other in the axial direction.

According to the present invention, the outer peripheral surface of the end cover is provided with a gasket groove having a predetermined width in the axial direction to divide the first communicating passage and the cushion valve inserting hole from each other, and the gasket groove is fitted with a gasket. The gasket groove may be a space curve gasket groove that is not contained in a plane perpendicular to the center line of the cylinder. Alternatively, the gasket groove may be a space curve gasket groove extending around the outer peripheral surface of the end cover. The arrangement may be such that the outer peripheral surface of the end cover is provided with space curve gasket grooves respectively surrounding the first communicating passage and the cushion valve inserting hole independently of each other. Because the configuration of a gasket groove for dividing the flow path is changed as described above, the first communicating passage (and the piping port) and the cushion valve inserting hole (and the cushion valve control hole) can be disposed to be close to or coincident with each other in the axial direction. Consequently, the axial dimension of the end cover can be reduced.

DETAILED DESCRIPTION OF THE PREFERRED EMBODIMENTS

Figure 1B:
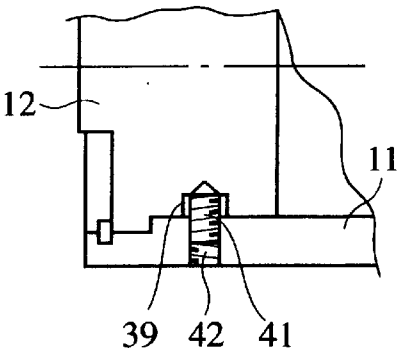
FIGS. 1*a* and 1*b* are a sectional view and a fragmentary sectional view, respectively, showing an embodiment of the present invention.
Figure 1A:
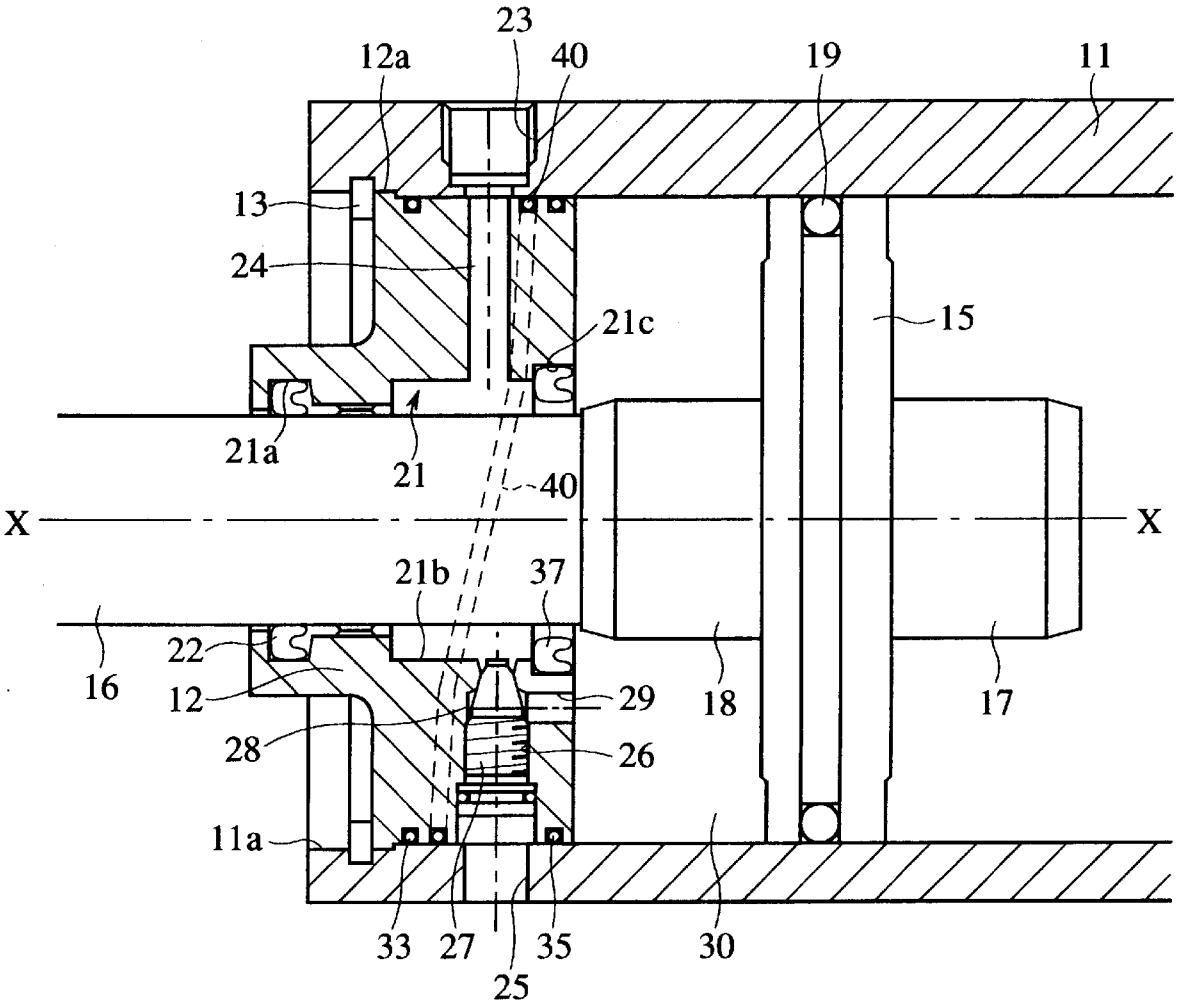

FIGS. 1*a* through FIG. 2*d* show an embodiment of a fluid pressure cylinder according to the present invention which uses a gasket groove having a predetermined width in the axial direction. In FIGS. 1*a* and 1*b,* members common to the embodiment and the prior art shown in FIG. 3 are denoted by the same reference characters as those in FIG. 3.

In FIG. 1*a,* a first communicating passage 24 and a cushion valve inserting hole 26 are disposed close to each other in the axial direction and 180 degrees displaced relative to each other with respect to the center line X—X. In other words, a piping port 23 is formed in the upper side of the cylinder tube 11, and a cushion valve control hole 25 is formed in the lower side of the cylinder tube 11. The piping port 23 and the cushion valve control hole 25 lie substantially in a plane perpendicular to the center line X—X.

Figure 2A:
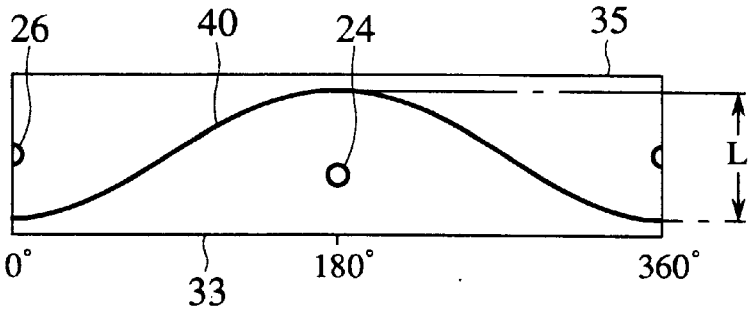
FIGS. 2*a* to 2*d* are development views illustrating space curve gasket grooves according to the embodiment of the present invention.
Figure 3:
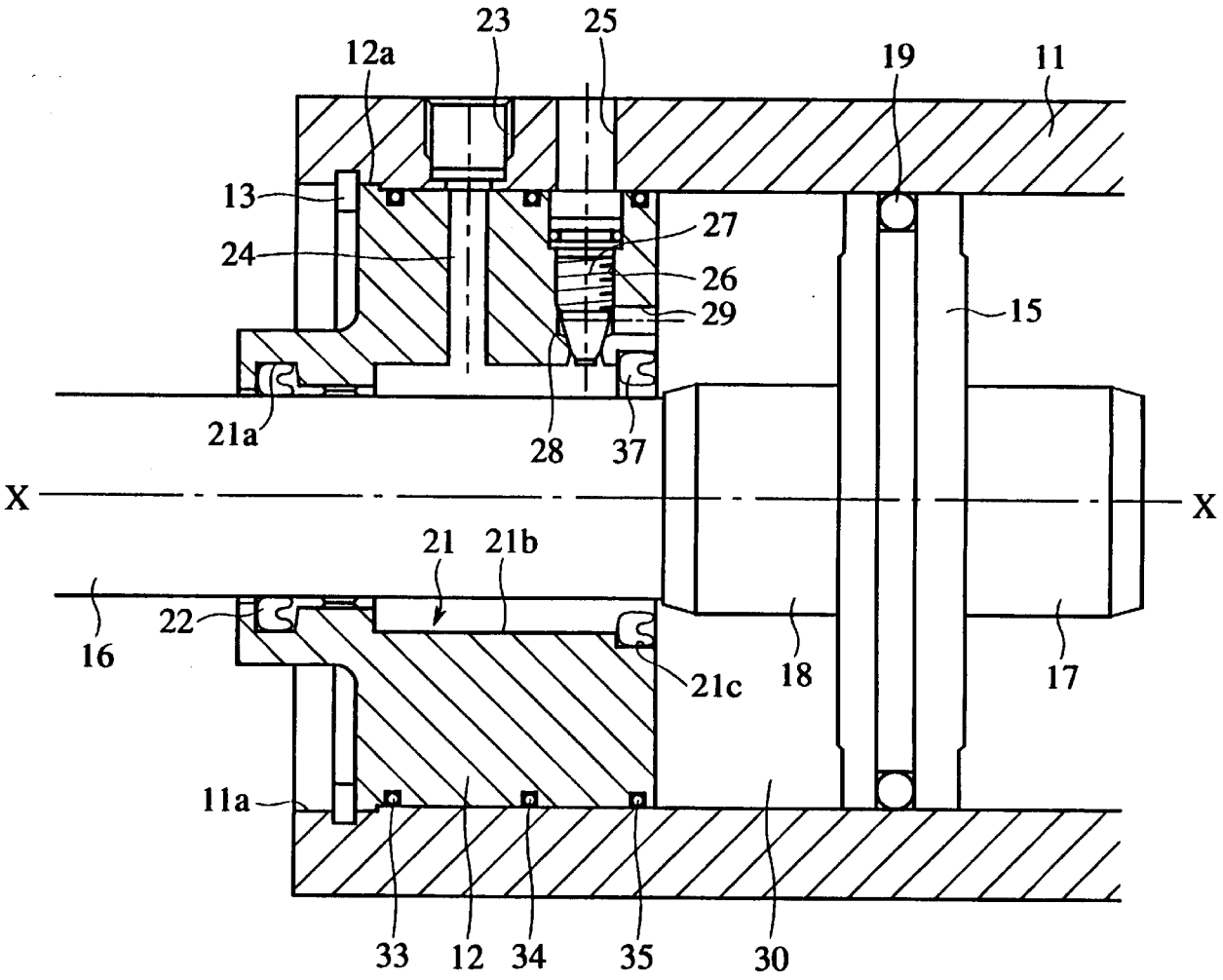
FIG.3 PRIOR ART
FIG. 3 is a sectional view showing a prior art.

As shown in FIG. 1*a,* which is a sectional view of the fluid pressure cylinder, and FIG. 2*a,* which is a development of gasket grooves, the outer peripheral surface of the end cover 12 is provided with a space curve gasket groove 40 extending around it in addition to a first annular gasket groove 33 and a third annular gasket groove 35. The first annular gasket groove 33 and the third annular gasket groove 35 are fitted with a first annular gasket 33*a* and a third annular gasket 35*a,* respectively, and the space curve gasket groove 40 is fitted with a space curve gasket 40*a*. It should be noted that illustration of the reference characters of the three gaskets is omitted in these figures. The first annular gasket groove 33 and the third annular gasket groove 35 are plane curve gasket grooves similar to those in the prior art. The first and third annular gasket grooves 33 and 35 are formed in two planes, respectively, which are perpendicular to the center line X—X and a predetermined distance away from each other. The space curve gasket groove 40 is a curved groove that is not contained in a plane perpendicular to the cylinder center line X—X. In the development view of FIG. 2*a,* the space curve gasket groove 40 is depicted by a curve similar to a sine curve. It should be noted that the space curve gasket groove 40 is included in gasket grooves having a predetermined width in the axial direction of the cylinder tube, together with plane curve gasket grooves diagonally intersecting the center axis of the cylinder tube.

In the development view of FIG. 2*a,* the space curve gasket groove 40 is depicted by a curve similar to a sine curve between the first annular gasket groove 33 and the third annular gasket groove 35, which are depicted by straight lines. The cushion valve inserting hole 26 is shown at a position between the third annular gasket groove 35 and the space curve gasket groove 40, and the first communicating passage 24 is shown at a position between the space curve gasket groove 40 and the first annular gasket groove 33. As will be understood from FIG. 1*a,* the first annular gasket 33*a* hermetically seals the joint between the cylinder tube 11 and the end cover 12 to prevent communication between the atmosphere on the one hand and the piping port 23 and the first communicating passage 24 on the other. The space curve gasket 40*a* hermetically seals the joint between the cylinder tube 11 and the end cover 12 to prevent communication between the piping port 23 and the first communicating passage 24 on the one hand and the cushion valve control hole 25 and the cushion valve inserting hole 26 on the other. The third annular gasket 35*a* hermetically seals the joint between the cylinder tube 11 and the end cover 12 to prevent communication between the cushion valve control hole 25 and the cushion valve inserting hole 26 on the one hand and the rod-side chamber 30 on the other.

Figure 2B:
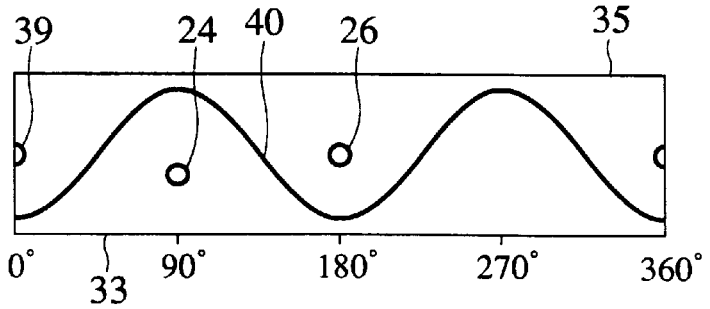

In the case of FIG. 2*a,* the first communicating passage 24 and the cushion valve inserting hole 26 are 180 degrees away from each other. In the case of FIG. 2*b,* the first communicating passage 24 and the cushion valve inserting hole 26 are 90 degrees away from each other. The piping port 23 is formed in the upper side of the cylinder tube 11, and the cushion valve control hole 25 is formed in a side portion of the cylinder tube 11. In the arrangement shown in FIG. 2*b,* a drilled hole 39 for preventing rotation is formed in the end cover 12 at a position 90 degrees away from the first communicating passage 24 in the opposite direction with respect to the cushion valve inserting hole 26, and a screw hole 42 for preventing rotation is formed in the cylinder tube 11 at a position corresponding to the drilled hole 39. A setscrew 41 is threaded into the screw hole 42, and the distal end of the setscrew 41 is engaged with the drilled hole 39 of the end cover 12, thereby securing the end cover 12 at a predetermined angle position relative to the cylinder tube 11. It should be noted that, as shown in FIG. 1*b,* the screw hole 42 is formed in the cylinder tube 11 by tapping, and the drilled hole 39 is provided in the end cover 12. The first communicating passage 24, the cushion valve inserting hole 26 and the screw hole 42 lie substantially in a plane perpendicular to the center line X—X. In the case of FIG. 2*b,* the space curve gasket groove 40 extending around the outer peripheral surface of the end cover 12 consists of 2 cycles per 360 degrees.

Figure 2C:
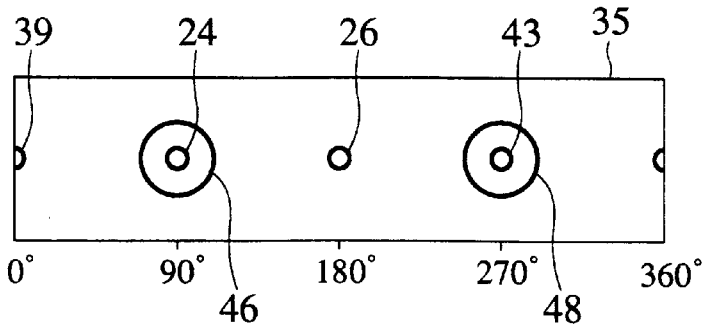

FIG. 2*c* shows a modification of the embodiment of the present invention, in which the drilled hole 39 for preventing rotation, the first communicating passage 24, the cushion valve inserting hole 26 and a check valve inserting hole 43 are formed in the outer peripheral surface of the end cover 12 at intervals of 90 degrees in a plane perpendicular to the center line X—X. The outer peripheral surface of the end cover 12 further has space curve gasket grooves 46 and 48 provided around the first communicating passage 24 and the check valve inserting hole 43, respectively. The space curve gasket grooves 46 and 48 surround only the respective openings of the passage 24 and the hole 43 but do not touch any grooves. The space curve gasket grooves 46 and 48 are fitted with respective space curve gaskets 46*a* and 48*a*. The space curve gasket 46*a* hermetically seals the first communicating passage 24 and the piping port 23, and the space curve gasket 48*a* hermetically seals the check valve inserting hole 43. In the case of FIG. 2*c*, the first annular gasket groove 33 can be omitted.

Figure 2D:
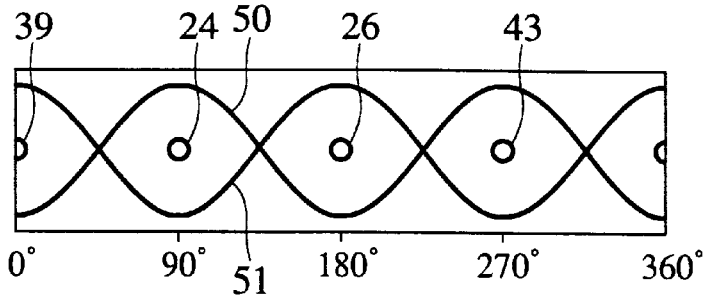

FIG. 2*d* shows another modification of the embodiment of the present invention, in which the drilled hole 39 for preventing rotation, the first communicating passage 24, the cushion valve inserting hole 26 and the check valve inserting hole 43 are formed in the outer peripheral surface of the end cover 12 at intervals of 90 degrees in a plane perpendicular to the center line X—X. The outer peripheral surface of the end cover 12 is provided with a first space curve gasket groove 50 consisting of 2 cycles per 360 degrees, which is similar to the space curve gasket groove 40, and further provided with a second space curve gasket groove 51 that is superimposed on the first space curve gasket groove 50 with a phase difference of 90 degrees. In FIG. 2*d*, the drilled hole 39, the first communicating passage 24, the cushion valve inserting hole 26 and the check valve inserting hole 43 are each surrounded by the first space curve gasket groove 50 and the second space curve gasket groove 51 and thus divided from other holes or passage. The first space curve gasket groove 50 and the second space curve gasket groove 51 are fitted with a single gasket adapted to fit to the configuration of the two grooves. The gasket hermetically seals each of the following passage and holes: ① the drilled hole 39 and the screw hole 42; ② the first communicating passage 24 and the piping port 23; ③ the cushion valve inserting hole 26 and the cushion valve control hole 25; and ④ the check valve inserting hole 43. In the case of FIG. 2*d*, both the first annular gasket groove 33 and the third annular gasket groove 35 can be omitted.

What is claimed is:

1. In a fluid pressure cylinder comprising a cylinder tube having a longitudinal axis, an end cover received an end portion of said cylinder tube, an outer peripheral surface of the end cover fitted to an inner surface of the cylinder tube, a piston rod slidably extending through a center bore in the end cover, a piping port formed in the end portion of the cylinder tube and communicating with the center bore of the end cover through a first communicating passage in the end cover, a cushion valve received in a cushion valve-receiving hole in the end cover that controls a flow in a bypass flow path that provides communication between the center bore of the end cover and a rod-side chamber in the cylinder tube, and a cushion valve control hole in the end portion of the cylinder providing access to the cushion valve to enable a needle portion of the cushion valve to be rotated, the improvement wherein the communicating passage and the cushion valve-receiving hole are located in an axial direction close to or in a plane perpendicular to the longitudinal axis and spaced apart relative to each other at a predetermined angle circumferentially with respect to the longitudinal axis, and wherein the outer peripheral surface of the end cover has a first continuous gasket groove having a first portion extending obliquely to the plane and located on one side circumferentially of the cushion valve-receiving hole between the cushion valve-receiving hole and the first communicating passage and a second portion extending obliquely to the plane and located on the other side circumferentially of the cushion valve-receiving hole between the cushion valve-receiving hole and the first communicating passage, and wherein a continuous gasket is received in the first gasket groove.

2. The improvement according to claim 1, wherein the outer peripheral surface of the end cover has a second continuous gasket groove lying in a plane perpendicular to the longitudinal axis of the cylinder at a position axially outward of the first communicating passage with respect to the rod-side chamber, and wherein the second gasket groove receives a second continuous gasket.

3. The improvement according to claim 1, wherein the outer peripheral surface of the end cover has a third continuous gasket groove lying in a plane perpendicular to the longitudinal axis of the cylinder at a position axially inward of the first communicating passage with respect to the rod-side chamber, and wherein the third gasket groove receives a third continuous gasket.

4. The improvement according to claim 1, wherein the first gasket groove is a space curve gasket groove that is not contained in a plane perpendicular to the longitudinal axis of the cylinder.

5. The improvement according to claim 4, wherein substantially all portions of the first gasket groove lie obliquely to a plane perpendicular to the longitudinal axis of the cylinder.

6. The improvement according to claim 2, wherein the first gasket groove is a space curve gasket groove that is not contained in a plane perpendicular to the longitudinal axis of the cylinder.

7. The improvement according to claim 3, wherein the first gasket groove is a space curve gasket groove that is not contained in a plane perpendicular to the longitudinal axis of the cylinder.

* * * * *